United States Patent [19]

Schwager et al.

[11] 4,347,403

[45] Aug. 31, 1982

[54] ELECTRICAL WAVEFORM SYNTHESIZER

[75] Inventors: Joseph E. Schwager, Endwell; Harry E. Urban, Endicott, both of N.Y.

[73] Assignee: The United States of America as represented by the Secretary of the Navy, Washington, D.C.

[21] Appl. No.: 143,257

[22] Filed: Apr. 24, 1980

[51] Int. Cl.[3] ..... G10L 1/00

[52] U.S. Cl. ..... 179/1 SA; 179/1 SM

[58] Field of Search ..... 179/1 SM, 15.55 R, 1 J; 84/1.01, 1.24; 328/14, 37; 332/16 R; 364/487, 703, 121; 307/271, 260

[56] References Cited

U.S. PATENT DOCUMENTS

| | | | |
|---|---|---|---|
| 3,500,213 | 3/1970 | Ameau | 328/14 |
| 3,577,084 | 5/1971 | Atcherson et al. | 328/14 |
| 3,777,278 | 12/1973 | Majeau et al. | 331/78 |
| 4,124,898 | 11/1978 | Munter | 364/703 |
| 4,223,583 | 9/1980 | Deutsch | 84/1.01 |
| 4,228,713 | 10/1980 | Gross | 84/1.01 |
| 4,244,262 | 1/1981 | Imai | 179/1 J |

OTHER PUBLICATIONS

Davis, "Synthesis of Steady-State Signal etc.", NOL Publication No. NOLTR 74-215, Dec. 5, 1974, pp. 57-75.

*Primary Examiner*—Mark E. Nusbaum
*Assistant Examiner*—E. S. Kemeny
*Attorney, Agent, or Firm*—Robert F. Beers; W. Thom Skeer; Frederick A. Wein

[57] ABSTRACT

This electrical waveform synthesizer uses a digital feedback loop circuit which includes selectable inputs for multiplex or recirculation operation, and a shift register whose shift rate is controlled by an adjustable precision clock so as to accurately adjust the frequency of the output waveform. The adjustable clock features a precision oscillator whose pulse rate is divided by a selectable-logic rate-divider circuit.

9 Claims, 4 Drawing Figures

ELECTRICAL WAVEFORM SYNTHESIZER

BACKGROUND OF THE INVENTION

The present invention relates to an electrical waveform synthesizer, and more particularly, to a synthesizer utilizing a shift register and a digital-to-analog converter for generating an acoustic waveform. Additionally, the present invention relates to a fine frequency vernier for providing a finely adjustable clock frequency to the shift register.

There are many requirements for an acoustic signal source which is compact, economical, and computer controlled for providing signal generating capability for a variety of requirements. Additionally, it is desirable that the acoustic signal source be able to simulate a plurality of acoustical environments, such as, to simultaneously generate a plurality of sine waves each with an assignable frequency and range of amplitudes to represent the acoustic signature such as an antisubmarine warfare (ASW) threat, apply a frequency vernier for simulating Doppler effects, individually control sine wave amplitudes to give the effect of tonal source strength dependence, vary the signal strength to represent detection response due to circle spreading and bottom bounce, and provide appropriate signals for testing a receiver sensitive to the synthesized acoustic waveforms. Additionally, it is desirable that any changes in signal output would cause a minimum of transients, and that unintentional harmonics should be attenuated at least forty dB.

SUMMARY OF THE INVENTION

Briefly, a waveform synthesizer is disclosed utilizing a shift register having a plurality of stages loadable by a digital signal source which may be a programmable logic means. Digital values loaded into the stages of the shift register are circulated among the stages by a signal applied to a clock input of the shift register. Outputted values are recirculated to the input of the shift register for providing a digital representation of a corresponding periodic analog waveform which is fed to a digital-to-analog converter for converting the readout digital values into a corresponding analog waveform. The analog waveform is then passed through a low pass filter for providing a filtered output of the waveform. The frequency of the output waveform is proportional to the clock frequency applied to the clock input, and is proportional to the number of digital samples per cycle loaded into the shift register.

A fine frequency vernier permits changing the clock frequency by very small amounts. The frequency vernier comprises a plurality of arithmetic units such as adders or the like connected in series and loadable with data provided by logic control means. The output of the respective adder is recirculated to the input of the respective adder under the control of a precision oscillator with the carry of the most significant figure adder comprising the clock pulse applied to the clock input.

OBJECTS OF THE INVENTION

With reference to the background of the invention hereinabove, accordingly, it is an object of the present invention to provide an electrical waveform synthesizer wherein stages of a shift register are loaded with digital values provided by a computer and the values are shifted in response to a signal applied to the clock input of the register for providing a digital representation of an analog waveform at the output, the output being applied to a digital-to-analog converter for providing an analog waveform. Another object of the present invention is to provide a fine frequency vernier comprising a plurality of arithmetic circuits connected in series and loadable by a programmable logic means such as a computer for providing a finely tunable clock frequency wherein the outputs of the arithmetic units are recirculated to the respective input of the arithmetic unit under the control of the precision oscillator. A further object of the present invention is to provide an electrical waveform synthesizer having a shift register with the stages loadable by logic circuitry, the number of loaded waveform values being inversely proportional to the frequency of the outputted waveform.

Yet another object of the present invention is to provide a waveform synthesizer having adjustable frequency bandpass output wherein a plurality of bandpass filters are switchably controllable by logic circuitry according to the frequency of the synthesized waveform.

Still another object of the present invention is to provide a waveform synthesizer wherein the total waveform output amplitude is adjustable by a plurality of attenuators switchably controllable by the logic circuitry.

A further object of the present invention is to provide a waveform synthesizer comprising a shift register wherein the stages are loadable by values from a programmable logic circuit with the amplitude of the produced waveform being adjustable by changes of the digital loaded values. Other objects of the present invention will become apparent to those skilled in the art as the disclosure proceeds with the description of the preferred embodiment of the present invention which will be more particularly pointed out in the appended claims.

BRIEF DESCRIPTION OF THE DRAWINGS

Reference is now made to the following drawings wherein.

DESCRIPTION OF THE PREFERRED EMBODIMENT

Figure 1:
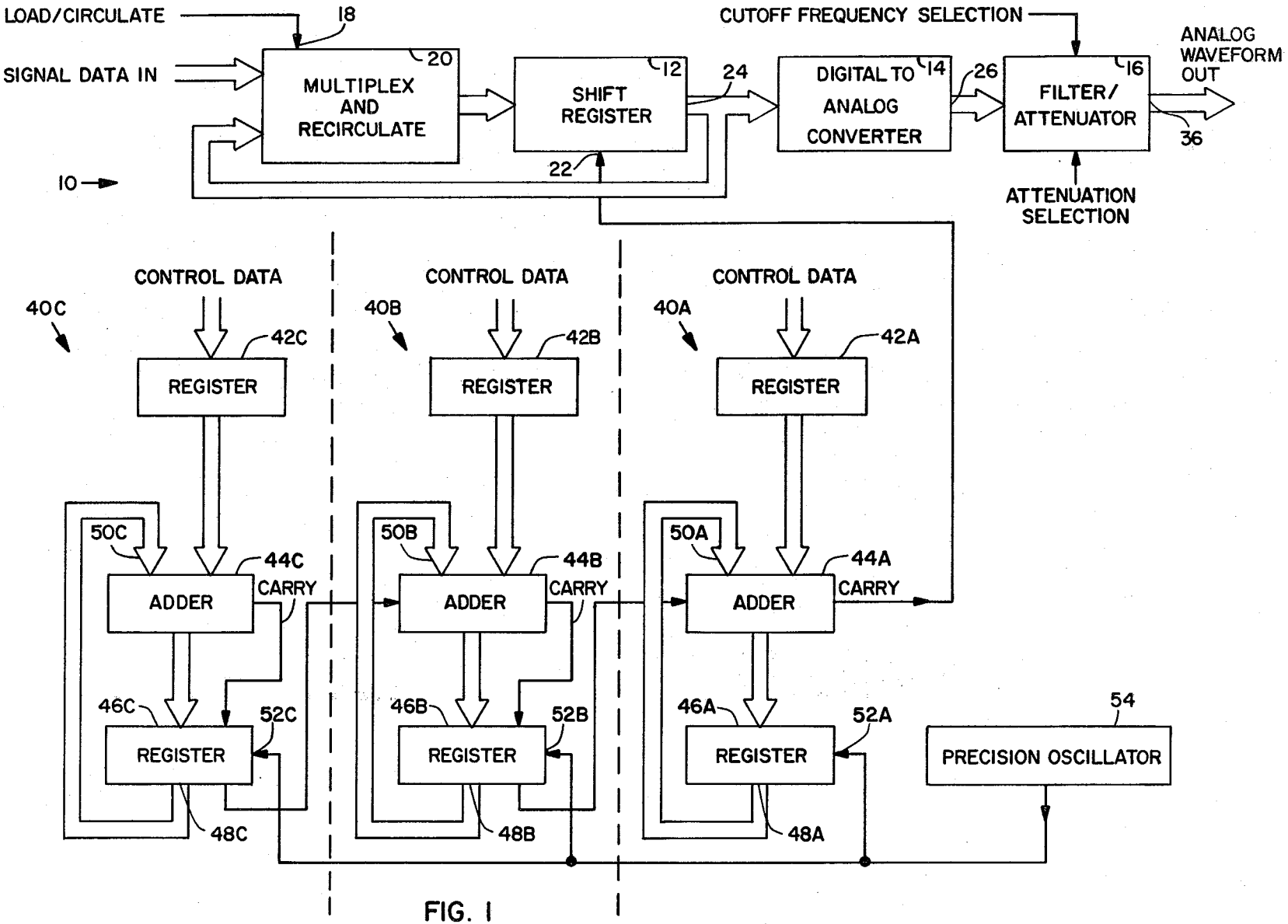
FIG. 1 shows a block diagram of a preferred embodiment of the present invention.

Reference is now made in the following description taken in connection with the accompanying drawings in which like reference numerals designate like parts throughout the figures thereof and wherein referring to FIG. 1 there is shown an electrical waveform synthesizer, generally designated 10, comprising a shift register 12, an digital-to-analog (D/A) converter 14 and a filter/attenuator 16. The internal stages of shift register 12 are loaded with signal data values under the direction of a load/circulate enable signal 18 which is applied to a multiplex and recirculate control 20 provided by a programmable logic or computer (not shown) with signal data values. The values loaded into the stages are stepped along between the stages by a clock frequency signal applied at clock input 22. The output of shift register 12 is fed to digital-to-analog converter 14 for conversion of the digital data values into an analog waveform which is then operated upon by filter 16 for removing unwanted harmonics from the waveform.

More particularly, shift register 12 comprises 1024 serial stages, each stage having a capacity of eight parallel bits. Digital values corresponding to amplitude segments of the resulting waveform are fed into the input, as enabled by load/circulate signal 18, of shift register 12 in step with the clock frequency at clock input 22 for serially loading the stages of shift register 12. Once shift register 12 is fully loaded, continuous application of the clock input 22 causes the loaded digital values to serially appear at output 24.

Figure 2:
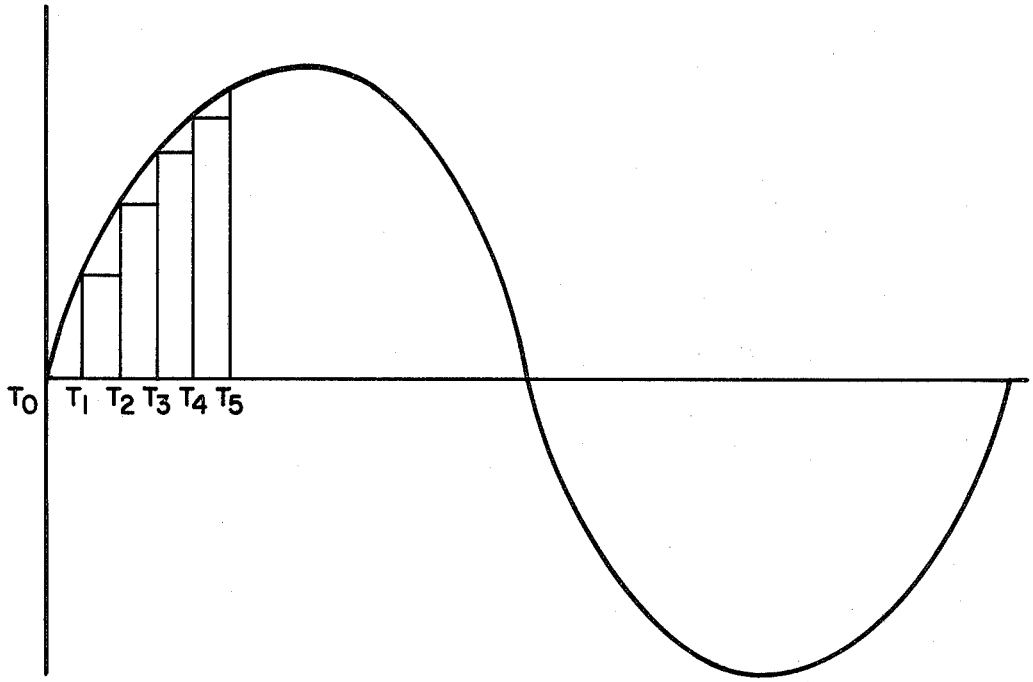
FIG. 2 shows the construction of an output waveform produced by the circuit of FIG. 1.

For a better understanding of the invention, FIGS. 2, 3 and 4 will now be described prior to finalizing FIG. 1 discussion. Referring now to FIG. 2 there is shown a resulting waveform, shown as a representative sine wave that is defined by the quantized or sampled amplitude values of output 24 at the times T1, T2 etc. which correspond to representative clock input pulses. Thus, for example, the waveform output for the time interval T3–T4 corresponds to the digital amplitude of output 24 during that respective time interval and the successive clock timed intervals correspond to respective digital values of amplitude of the resultant analog waveform during the respective successive time interval. In the exemplary embodiment, the period of a repetitious wave is related to the number of clock periods required to make up the waveform period. If all of the shift register stages are utilized to synthesize one period of waveform, the wave will be divided into 1024 time segments and the amplitude values of each of the segments can be any one of 256 possible values which is the maximum possible with a eight bit word. Thus, shift register 12 can accordingly be loaded with a plurality of wave cycles in which case the number of clock periods making up a period of waveform is correspondingly reduced. Although, the waveform shown in FIG. 2 is a sine wave, the digital value of successive clock periods can form a complex wave having a plurality of Fourier and non-harmonically related components.

When load/circulate enable signal 18 is in the load mode, the loaded values once read out are lost and a continuous output requires continuous input. In the alternative, once shift register 12 is loaded by the computer, load circulate enable signal 18 under the control of the computer can switch multiplex and recirculate circuitry 20 into the recirculate mode in which case output 24 of shift register 12 is recirculated back into the input reloading each of the readout values into the input for continuous output without further input from the computer. In such a case, the digital frequency of the output waveform is the fastest frequency of the shift generator clock which is limited by the fastest shift rate of shift register 12. The lowest waveform frequency depends upon the number of stages of shift register 12 and the length of time per waveform sample which can be tolerated.

Figure 3:
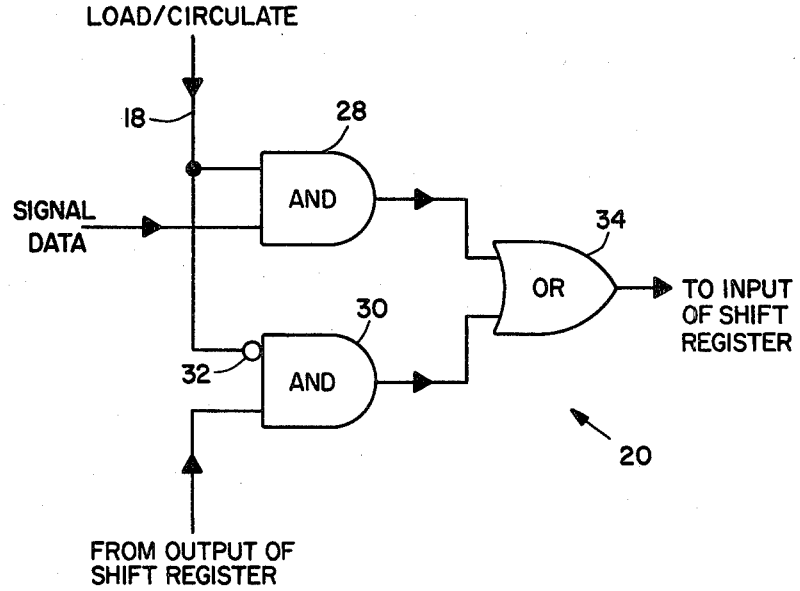
FIG. 3 shows a block diagram of the multiplex and recirculate block of FIG. 1.

One example of a multiplex and recirculate control 20 is shown in FIG. 3 and comprises an AND gate 28 having input of signal data and load/circulate enable signal 18, and AND gate 30 having a negated input 32 connected to load/circulate enable signal 18 with the other input being connected to the output of shift register 12. The outputs of AND gates 28 and 30 are connected to the input of OR gate 34 the output of which is connected to the input of shift register 12. Depending upon whether the load/circulate line is a 1 or 0 determines which of gates 28 and 30 will conduct the respective signal data or shift register output to OR gate 34 and in turn to the input of shift register 12. In the exemplary embodiment, when load/circulate enable signal 18 is a 1, AND gate 28 is enabled and the signal data is conducted through to OR gate 34 with negated input 32 keeping AND gate 30 open. FIG. 3 represents but one embodiment of multiplex and recirculate control 20 and it is understood that equivalents will occur to those skilled in the art.

When in the recirculation mode, all sine wave signals must span the register stages within even multiples of $\pi$ radian phase angles. If odd multiples are selected, the output sign must be changed before recycling. For even multiples of $\pi$, no sign change is necessary. Therefore, signals spanning one register must comprise all odd or all even phase multiples.

As previously disclosed, shift register 12 is loaded with computer generated discrete amplitude values for equally spaced time increments of the clock frequency. For analog conversion, shift register 12 inherently provides a digital sample and hold output to the digital-to-analog converter 14 for one clock pulse interval. Digital-to-analog converter 14 can be any D/A coverter which meets the circuit requirements and is commercially available.

In the exemplary embodiment the harmonic content of the output waveform will be very low since the number of digital samples per waveform Hertz varies inversely with the frequency of the waveform, i.e. more samples are used as the waveform frequency decreases further below the cutoff frequency of filter 16. When high frequency discrete signals are generated, the cutoff frequency of filter 16 can be temporarily increased in a manner which will be discussed hereinafter.

When new discrete samples are to be loaded into shift register 12, the computer generated discrete samples are serially loaded through a buffer if necessary into a respective stage with the proper enabling of load/circulate signal 18. In cases where shift register 12 content does not change during operation, a programmable read only memory (PROM) can be used such as for start-up and refresh loading.

Each waveform amplitude at output 26 can be individually changed by the control computer by calculating and loading the correct digital amplitude values into the respective shift register stages. When the amplitude of the composite signal level is to be changed an alternate amplitude adjustment can be made by having the computer control an output attenuator which appropriately attenuates the entire output of the digital-to-analog converter as will be described hereinafter.

Figure 4:
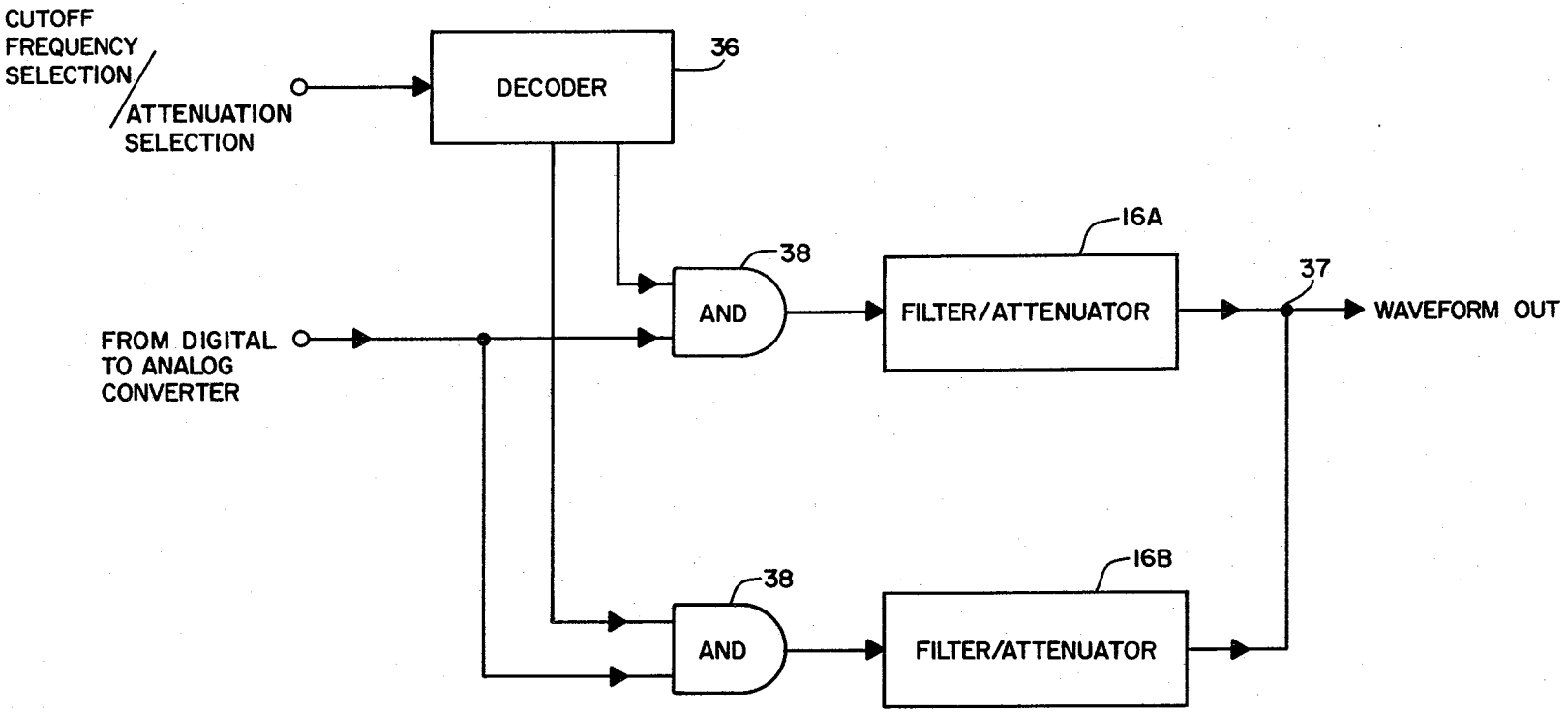
FIG. 4 shows a block diagram of the filter/attenuator block of FIG. 1.

Referring now to FIG. 4, there is shown a block diagram of filter/attenuater 16. In the normal signal mode, filter 16 comprises a low pass filter for filtering out harmonic components present at output 26 of digital-to-analog converter 14. Harmonic components are primarily caused by the limited number of digital samples for generating the waveform because of limitations on the number of shift register 12 stages available, i.e., sudden changes of level caused by the sudden change of digital output value at output 24 between the discrete samples values (see FIG. 2) causes harmonic components to appear at output 26. Accordingly, filter 16 is a low pass filter having a high frequency cutoff slightly above the highest frequency to be generated. However, it is within the contemplation of the present invention, that filter 16 can be a bandpass filter or a high pass filter as applicable, and therefor, for purposes of claim interpertation, reference to a bandpass filter is to be construed as any of the three possible configurations with a low pass filter having a bandpass from its lowest frequency pass component to the high frequency cutoff point. Additionally, filter 16 can be comprised of any desired filter configuration, e.g. LC, RC, Bridge "T", Butterworth, etc. either active or passive and connected in series or parallel to provide the desired characteristics.

As disclosed herein above, there are instances where it is desirable that filter/attenuater 16 be adjustable. In such instances, a plurality of filter/attenuater 16 wired in parallel with segments having different characteristics. The control signal, whether it be for frequency selection or attenuation selection, can be fed into decoder 36 having a plurality of outputs each connected to AND gates 38 with the selected segment 16 being chosen by the decoder circuitry in a manner known in the art. The signal from digital-to-analog converter 14 is fed into each of the other inputs of AND gates 38 with the chosen AND gate being connected to the desired filter/attenuater segment 16 A, B for passing the signal to output 37. In those instances where a selection between only two filter/attenuater segments 16 is desired the circuit of FIG. 3 can be used. However, in the event that a larger number of selection is necessary, the circuit shown in FIG. 4 using a decoder having an appropriate number of inputs and outputs can be used in a manner known in the art. For example, a decoder having four input leads and sixteen output leads can be connected to sixteen corresponding AND gates and respective filter-/attenuater segments 16.

It is within the contemplation of the present invention that filter/attenuator segments 16 can be attenuators, the attenuators being of any kind required for the application, e.g. resistive, capacitive, decade, active, or passive, and connected in series or parallel as appropriate.

The input clock signal at input 22 can be provided by any source known in the art or can be provided directly by the computer. However, when it is desirable to synthesize a waveform having Doppler effect characteristics, such as, when it is necessary to provide a very small frequency shift of for example one/one thousand Hertz for a waveform in the 100 Kilohertz or megahertz frequency range, such a requirement would require a counter for the shift register clock control that is much too large to be practical. Accordingly, a fine frequency vernier function provided by computer controlled serial adders which divide the clock rate frequency into independent ranges is used. The computer supplies appropriate data to control the adders which then generate the needed clock rate output under the control of a precision oscillator.

Referring again to FIG. 1, there is shown a plurality of frequency division circuits generally designated 40 A, B, and C comprising respective registers 42 A, B, and C for receiving digital data from the computer. The data of respective register 42 is then loaded into an arithmetic unit, the exemplary embodiment being respective adders 44 A, B and C. The output of respective adder 44 is fed into a respective register 46. Output 48 of respective register 46 is then fed back to respective input 50 of adder 44 under the control of a signal applied to respective control input 52 of the respective register 46 by precision oscillator 54.

More particularly, in the exemplary embodiment, adders 44, are full binary adders. Register 42 serves as a buffer for the number loaded into the adder from the computer. Register 46 must have sufficient capacity to accept the highest number readout from the respective adder.

Referring now specifically to the frequency division circuit 40 A, for each positive going excursion of precision oscillator 54, the output of adder 44 A, being the numerical value stored in register 46 A, is fed back into input 50 A and is added to the contents already in adder 44 A. When the sum of the most significant figure adder 44 A exceeds the capacity of the adder, a carry is generated which serves as the clock pulse fed to clock input 22 of shift register 12. In a similar manner, numbers provided to frequency division circuits 40 B and C by the computer are reentered into the input of the respective adder under the control of precision oscillator 54. However, the carry of adders 44 B, C is stored in a separate bit provided in registers 46 B, C with the respective carry being fed into the next series adder on the next positive excursion of oscillator 54, i.e., the carry stored in register 46 C is fed to adder 44 B and the carry stored in register 46 B is fed into adder 44 A. In this manner, the respective adder groups are made independent of each other by latching the carry bit in an unused register position thus eliminating the need to propogate the carry through entire frequency vernier circuit 40 in one clock period.

In this manner by appropriate computer loading of the adders, i.e. circuit 40 A being a course frequency control, circuit 40 B being a fine frequency control, and circuit 40 C being a very fine frequency control, the clock pulse frequency to shift register 12 can be very finely changed finely shifting the frequency of the output waveform as explained above. For example, by loading a sufficiently large number into adder 44 A, a carry will be generated with each positive excursion of oscillator 54, which in the exemplary embodiment, has a frequency of 10.48576 Mhz. Thus, if all of the 1024 serial stages of shift register 12 are loaded with one cycle of the waveform, the frequency of the output waveform will be that of oscillator 54. Accordingly, if two cycles of the waveform are stored in shift register 12, the frequency of the output waveform will be twice that of oscillator 54. On the other hand, if the number loaded into adder 44 A is such that the carry will be generated with every other addition of adder 44 A, the frequency of the output waveform will be one-half of the frequency for the samples previously given. Thus, by appropriate choice of loaded number into adders 44, with knowledge of the precision oscillator frequency of oscillator 54, the clock frequency present at clock input 22 can be precisely determined and controlled.

Frequency division circuits 40 B and C work in a like manner, in their respective cases, the number loaded into the respective adder can be such that the output from register 46 B occurs every tenth addition of adder 44 A and the output of register 46 C is added into adder 44 B every tenth addition of adder 44 B. Thus, the output of adder 44 A can be very slightly changed by adder 44 B through respective register 46 B and adder 46 B in turn can be very slightly changed by adder 44 C through register 46 C. Thus, output frequency of adder 44 A and accordingly, the clock frequency available at clock input 22, can be changed very small amounts by appropriate loading of the respective adders to change the frequency of recirculation of the output of shift register 12 and accordingly microscopically change the frequency of the waveform at output 36.

The preferred embodiment as disclosed uses adders 44 A, B and C as the arithmetic elements. It is within the contemplation of the present invention that other suitable arithmetic elements can be used, e.g., multipliers, subtractors.

Thus there is disclosed an electrical waveform synthesizer comprising a shift register loadable by digital values provided by programmable logic. The values are stepped along stages of shift register 12 by a clock frequency applied to a clock input with the output values being recirculated to the input of the shift register and converted by a digital-to-analog converter to an output waveform which is fed to a low pass filter for removing undesirable harmonics of the waveform. The outputted waveform frequency can be shifted by a fine frequency vernier comprising a plurality of arithmetic circuits connected in series, each arithmetic circuit being loadable by the computer and under the control of a precision oscillator.

It is understood, that the foregoing disclosure relates to only a preferred embodiment of the invention and that numerous modifications or alterations will occur to those skilled in the art without departing from the spirit and scope of the invention as set forth in the appended claims.

What is claimed is:

1. An electrical waveform synthesizer comprising:

multiplex and recirculate means having a data input, a load/circulate input, and a recirculated signal input for receiving a digital input signal;

a shift register connected to said multiplex and recirculate means for receipt of digital output signals therefrom and having a plurality of loadable stages for loading digital signals therein, a clock input where clock signals maybe applied to effect shifting of data between said plurality of loadable stages, and an output which is connected to said recirculated signal input of said multiplex and recirculate means;

a digital-to-analog converter connected to said output of said shift register; and clock means connected to the clock input of said shift register said clock means including a plurality of frequency division circuits, each frequency division circuit further including;

an input register for receiving control signals;

an adder circuit connected to said input register for receipt of augend signals therefrom, an output register connected to said adder circuit to receive signals therefrom and connected to said adder circuit to provided addend signals therefor and an output connected to adder circuits of succeeding frequency circuits, if any, for providing additional addend signals therefor, the adder circuit of one of said frequency circuits having an output connected to said shift register clock input, and an oscillator having an output connected to each of said output registers of said plurality of frequency division circuits.

2. The synthesizer of claim 1 further comprising a low pass filter for providing a filtered output of the analog waveform.

3. The synthesizer of claim 1 wherein the shift register output is recirculatable at a rate sufficient to provide desired output waveform frequencies.

4. The synthesizer of claim 2 wherein the cut-off high frequency of the low pass filter is proximally above the highest output frequency of the converter.

5. The synthesizer of claim 4 wherein the cut-off frequency of the filter is controllable.

6. The synthesizer of claim 1 wherein the number of digital segments of the waveform varies inversely with the frequency of the waveform.

7. The synthesizer of claim 1 wherein the respective stages are loadable with different values by the logic means at a rate related to the clock frequency and the means for recirculating is inhibitable upon command from the logic means.

8. An electrical waveform synthesizer according to claim 1 in which said multiplex and recirculate means inhibits recirculation upon a predetermined signal being applied to said load/circulate input.

9. An electrical waveform synthesizer according to claim 1 wherein said output register of said frequency divider circuit is configured to feed the value stored therein to said adder only when the oscillator is of a predetermined polarity.

* * * * *